US009777496B2

(12) United States Patent
Karales

(10) Patent No.: US 9,777,496 B2
(45) Date of Patent: Oct. 3, 2017

(54) PROTECTIVE DEVICE FOR A POOL SAFETY COVER AND A METHOD OF USING THE SAME

(71) Applicant: William Karales, Smithtown, NY (US)

(72) Inventor: William Karales, Smithtown, NY (US)

( * ) Notice: Subject to any disclaimer, the term of this patent is extended or adjusted under 35 U.S.C. 154(b) by 184 days.

(21) Appl. No.: 14/570,648

(22) Filed: Dec. 15, 2014

(65) Prior Publication Data

US 2015/0184409 A1 Jul. 2, 2015

Related U.S. Application Data

(60) Provisional application No. 61/964,274, filed on Dec. 30, 2013.

(51) Int. Cl.
*E04H 4/00* (2006.01)
*E04H 4/14* (2006.01)
*E04H 4/10* (2006.01)

(52) U.S. Cl.
CPC ..... *E04H 4/141* (2013.01); *E04H 4/10* (2013.01)

(58) Field of Classification Search
CPC ..... E04H 4/084
USPC ..... 4/488–513; 482/55
See application file for complete search history.

(56) References Cited

U.S. PATENT DOCUMENTS 4,233,695 A * 11/1980 Rowney ..... E04H 4/10 210/251
4,512,044 A * 4/1985 Clark ..... A47K 3/002 4/581
4,601,072 A * 7/1986 Aine ..... E04H 4/08 126/566
4,620,333 A * 11/1986 Ritter ..... A61G 7/02 5/604
4,723,953 A * 2/1988 Rosenbaum ..... A61F 13/53743 604/369
5,388,314 A * 2/1995 Vella ..... E04H 4/10 24/462
5,970,531 A * 10/1999 Demby ..... E04H 4/108 4/498
2003/0037371 A1* 2/2003 Shaw ..... E04H 4/10 4/498
2003/0051432 A1* 3/2003 Haberler ..... E04H 4/0043 52/741.11
2003/0131556 A1* 7/2003 Breslin ..... E04H 4/0018 52/745.02
2005/0268392 A1* 12/2005 Hold ..... A61H 33/6015 4/506
2006/0080778 A1* 4/2006 Chambers ..... A47C 21/044 5/652.2

(Continued)

*Primary Examiner* — Lori Baker
(74) *Attorney, Agent, or Firm* — Sand & Sebolt

(57) ABSTRACT

A protective device for use with a cover for a swimming pool; said protective device comprising: a pad having an upper surface, a lower surface, an interior peripheral edge and an exterior peripheral edge; wherein said paid has a width extending between the interior and exterior peripheral edges; and a thickness extending between the upper and lower surfaces; and wherein the pad is adapted to be positioned between a coping adjacent an edge of a pool and a bottom surface of the cover; and a plurality of air spaces defined in the pad and which enable air or water to flow through the pad. The pad grips the coping and remains in place without additional securement.

20 Claims, 9 Drawing Sheets

(56) References Cited

U.S. PATENT DOCUMENTS

| | | | | |
|---|---|---|---|---|
| 2007/0220667 | A1* | 9/2007 | Kanetis | E04H 4/084 4/501 |
| 2008/0086808 | A1* | 4/2008 | Sutton | |
| 2009/0165200 | A1* | 7/2009 | Kanetis | E04H 4/084 4/498 |
| 2012/0030879 | A1* | 2/2012 | Waters | A47D 7/00 5/663 |
| 2015/0190290 | A1* | 7/2015 | Park | A61F 13/472 604/359 |

* cited by examiner

PROTECTIVE DEVICE FOR A POOL SAFETY COVER AND A METHOD OF USING THE SAME

CROSS-REFERENCE TO RELATED APPLICATIONS

This application claims the benefit of U.S. Provisional Application Ser. No. 61/964,274, filed Dec. 30, 2013, the entire specification of which is incorporated herein by reference.

BACKGROUND OF THE INVENTION

Technical Field

This invention is directed to accessories for pools such as swimming pools. More particularly, this invention is directed to safety covers. Specifically, this invention is directed to a protective pad made of a loosely woven fibrous material which is positioned between the underside of the safety cover and the coping surrounding the edge of the pool.

Background Information

A large percentage of swimming pools are closed for the winter season and owners install a safety cover that is a sturdy custom-made vinyl or nylon cover. The cover has straps every couple of feet that are engaged with pop-up posts which are located proximate the edge of the pool. The cover keeps leaves and such debris out of the pool. Additionally, if an animal or person were to walk on the cover, the cover is strong enough to support their weight and prevent them from falling into the pool. The cover thus permits the person or animal to get safely off the cover.

When a pool is covered with this type of safety cover, there may be movement of the cover in response to strong winds, and the like. This movement may cause the cover to come into contact with the concrete or stone coping which surrounds the edge of in-ground pools, causing the cover to become damaged. This weakens the cover and potentially could permit a person or animal to break through the cover and fall into the pool. Additionally, strong winds may lift the edge of the cover up slightly and leaves may blow under the same and into the pool.

SUMMARY

There is therefore need in the art to provide a cover for a pool or a method of using a cover such that the cover is less prone to being worn away by the coping surrounding the edge of a pool when shifted by winds.

The invention may provide a pad that is positioned between the underside of the cover and the coping which surrounds a pool edge. The pad may be attached to the cover or to pop-up posts used to secure the cover in place. The pad is fabricated from a material having a loose and random weave of waterproof fibers, such as polyvinyl chloride (PVC) fibers. The loose weave of the fibers permits the pad to breathe. Because the pad is positioned between the cover and coping, the pad reduces the possibility of the cover chafing on the coping. Additionally, the added weight and obstruction provided by the woven fibers substantially prevents leaves from blowing into the pool because the woven region prevents the ingress of the leaves into the region between the underside of the cover and the upper surface of the water in the pool. Still further, because the woven fibers are loosely engaged with each other, air or water is able to flow through spaces in the fibrous pad. This ensures that the pool water remains fresher while covered.

In one aspect, the invention may provide a protective device for use with a cover for a swimming pool; said protective device comprising a pad having an upper surface, a lower surface, an interior peripheral edge and an exterior peripheral edge; wherein said paid has a width extending between the interior and exterior peripheral edges; and a thickness extending between the upper and lower surfaces; and wherein the pad is adapted to be positioned between a coping adjacent an edge of a pool and a bottom surface of the cover. The pad may define a plurality of air spaces therein which enable air or water to flow through the pad.

In another aspect, the invention may provide a combination of a cover for a pool having an upper surface, a lower surface, and a peripheral edge extending between the upper and lower surfaces; a pad positionable between the cover and a coping adjacent an edge of the pool; said pad having an upper surface, a lower surface, an interior peripheral edge and an exterior peripheral edge; wherein said paid has a width extending between the interior and exterior peripheral edges; and a thickness extending between the upper and lower surfaces; and a plurality of air spaces defined in the pad and which enable air or water to flow through the pad between an environment outside the cover and a region between an upper surface of water in the pool and the lower surface of the cover.

In another aspect, the invention may provide a method of securing a cover over an opening to a pool; providing a pad having an upper surface, a lower surface, an interior peripheral edge and an exterior peripheral edge; wherein said paid has a width extending between the interior and exterior peripheral edges; and a thickness extending between the upper and lower surfaces; and wherein the pad is adapted to be positioned between a coping adjacent an edge of a pool and a bottom surface of the cover; and a plurality of air spaces defined in the pad and which enable air or water to flow through the pad; positioning the pad on a coping surrounding an edge of the pool; extending the cover over an opening to the pool and over the upper surface of the pad; and securing the cover in place.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
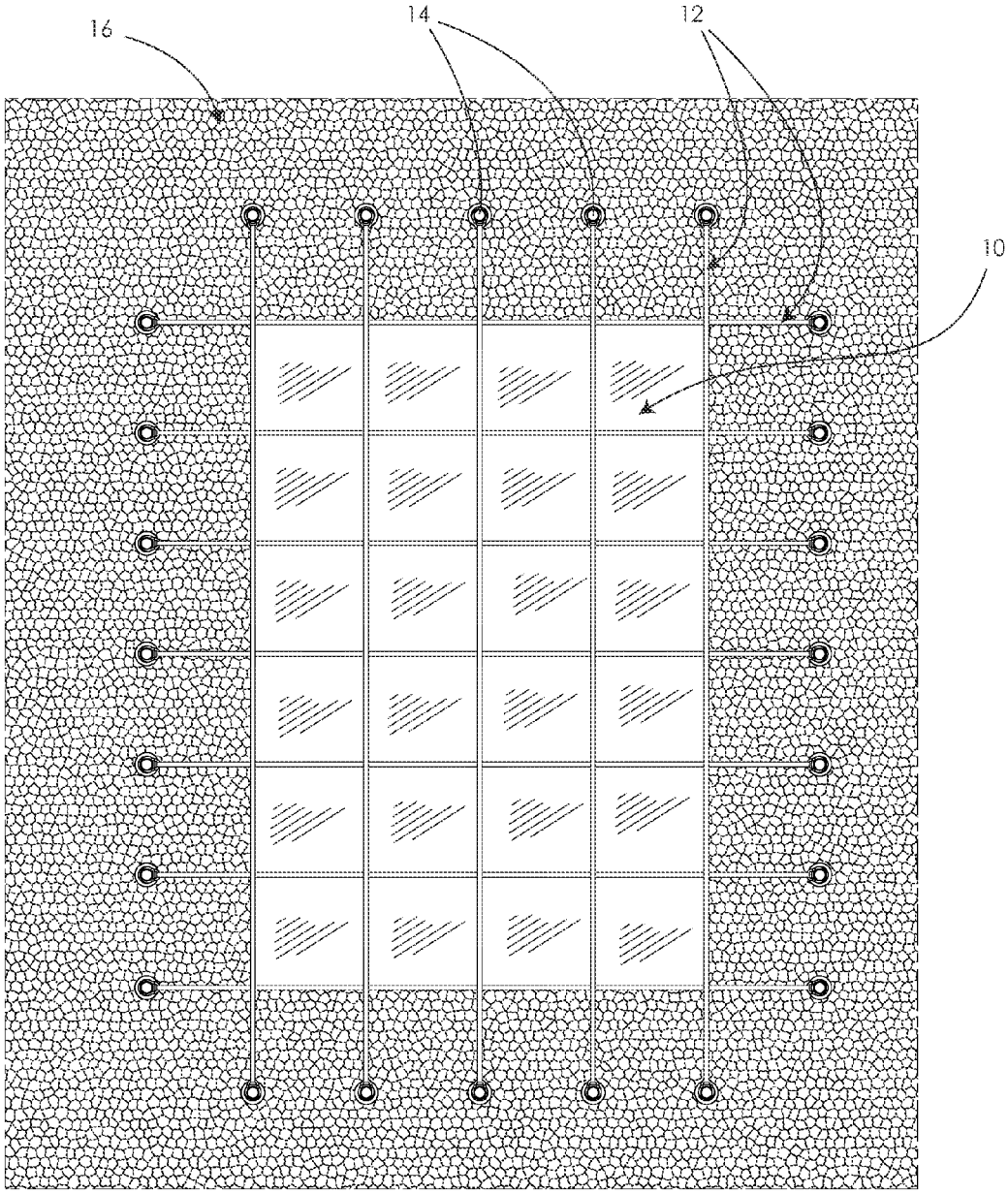
FIG. 1 is a top view of a pool cover secured over a pool by way of a strap assembly.

FIG. 1 shows a safety cover 10 for a pool which is engaged via a strap assembly 12 to a plurality of pop-up posts 14 located at spaced intervals on a pool deck 16. Safety cover 10 has an exterior surface 10*a*, an interior surface 10*b*, a first end 10*c*, second end 10*d*, first side 10*e*, and second side 10*f*. Strap assembly 12 comprises a plurality of individual straps which preferably are fixedly secured to strap assembly in any suitable manner, such as be sewing straps thereto. (It will be understood that pop-up posts 14 could be located on a ground surface surround the outermost peripheral edge of the pool deck 16.)

Figure 2:
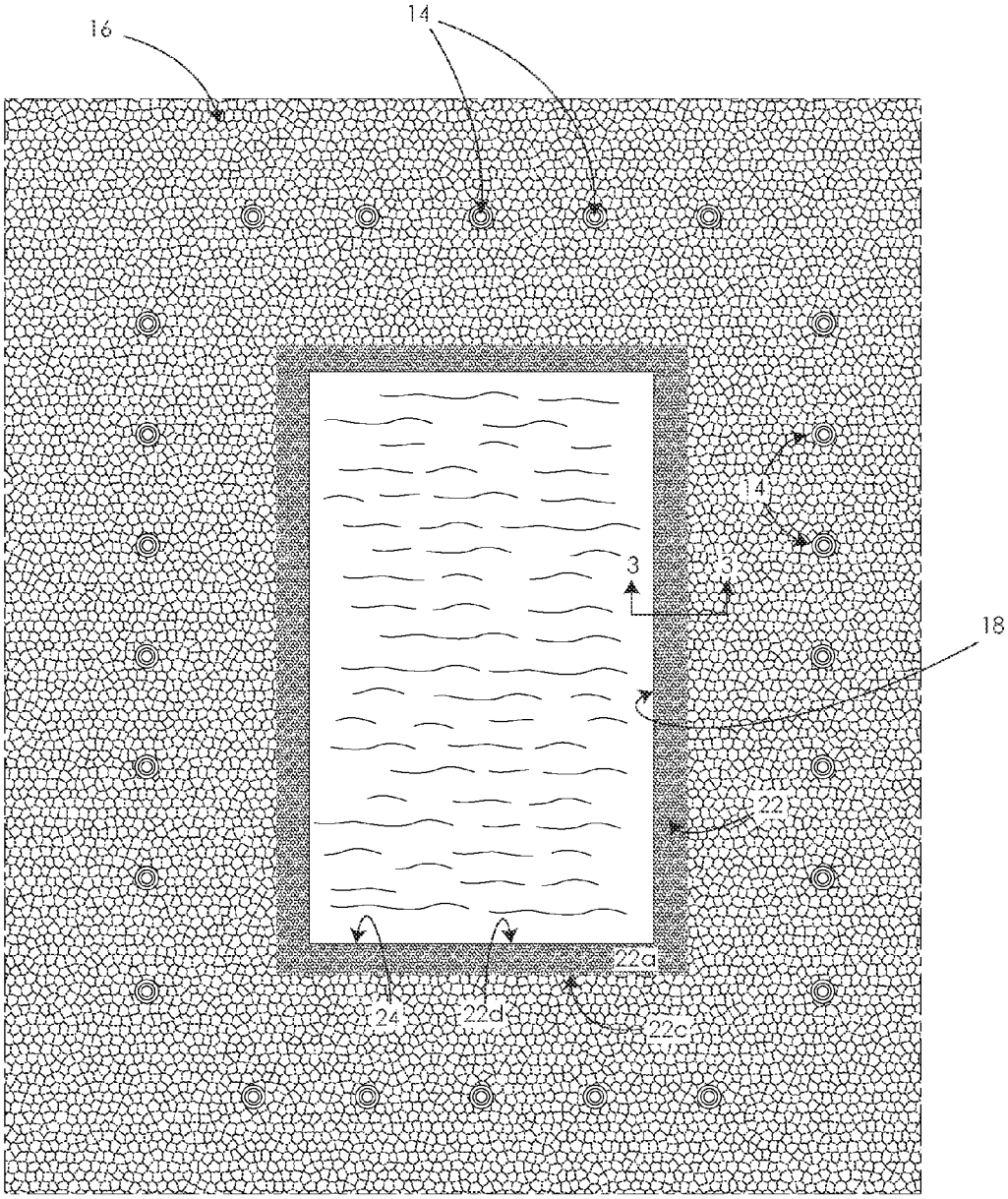
FIG. 2 is a top view of the pool with the pool cover and strap assembly removed and showing a pad in accordance with an aspect of the invention installed on the coping surrounding the pool edge.

In FIG. 2, the cover has been removed for clarity. FIG. 2 shows pool deck 16 surrounding a swimming pool 18 which has a quantity of water 20 therein. A pad 22 in accordance with an aspect of the present invention is shown in FIG. 2 as well. Pad 22 frames the perimeter of pool 16 and rests upon coping 24 (FIG. 3) at the edge of pool 16.

Pool 18 as illustrated herein is generally rectangular in shape. Consequently, the pad 22 for use therewith is also generally rectangular in shape and generally conforms to the shape of the coping 24 surrounding pool 18. Pad 22 has a similar appearance to a mat used in a picture frame which would surround the picture itself. Pad 22 thus has an upper surface 22*a*, a lower surface 22*b*, an outer perimeter edge 22*c* and an inner perimeter edge 22*d*. Inner and exterior perimeter edges 22*c*, 22*d* are each generally rectangular in shape and are parallel to each other. Inner perimeter edge 22*d* bounds and defines an aperture 22*e* which generally corresponds in size and shape to the opening to the water-containing cavity of the pool 18 itself. The width "W" of pad 22 between outer perimeter edge 22*c* and inner perimeter edge 22*d* may be selected to be of any suitable and desired width. Suitable widths "W" include but are not limited to from about 8 inches up to about 2 feet in size. Similarly, the overall dimensions of pad 22 will be selected to be complementary to the specific pool 18, pool deck 16 and coping 24. Pad 22 may be fabricated from a plurality of sections or may be a single, unitary piece. So for example, pad 22 may be comprised of two separate, linear sections which are to be located adjacent the two ends of the pool 18 and two additional linear sections which are to be located adjacent the two sides of the pool 18. Any suitable configuration of sections may be utilized, although the use of individual linear sections may be easier to put into position adjacent a rectangular pool as the sections can be simply be unrolled during installation and rolled up for storage when no longer needed.

It will be understood that if the pool is of a different shape, then the pad will be similarly complementary shaped to the coping of that differently shaped pool.

Figure 3:
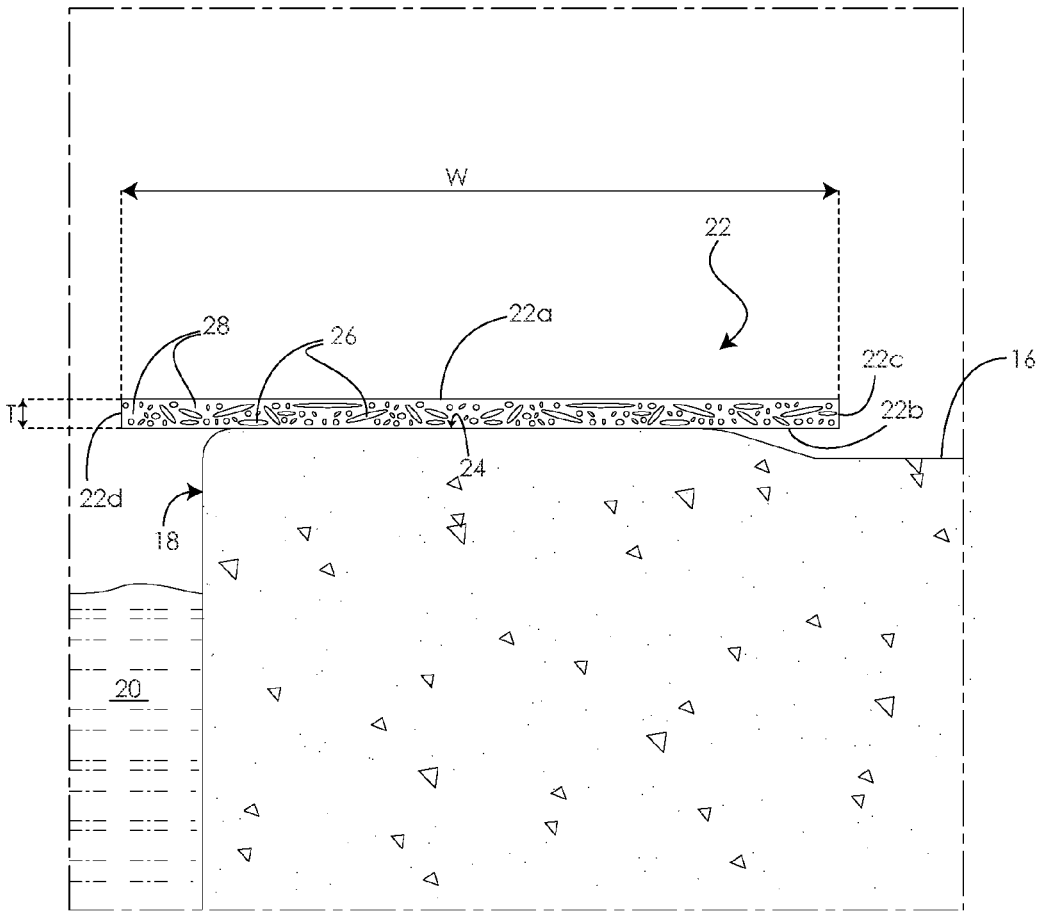
FIG. 3 is an enlarged cross-sectional view of the pad on the coping surrounding the pool taken along line 3-3 of FIG. 2.
Figure 4:
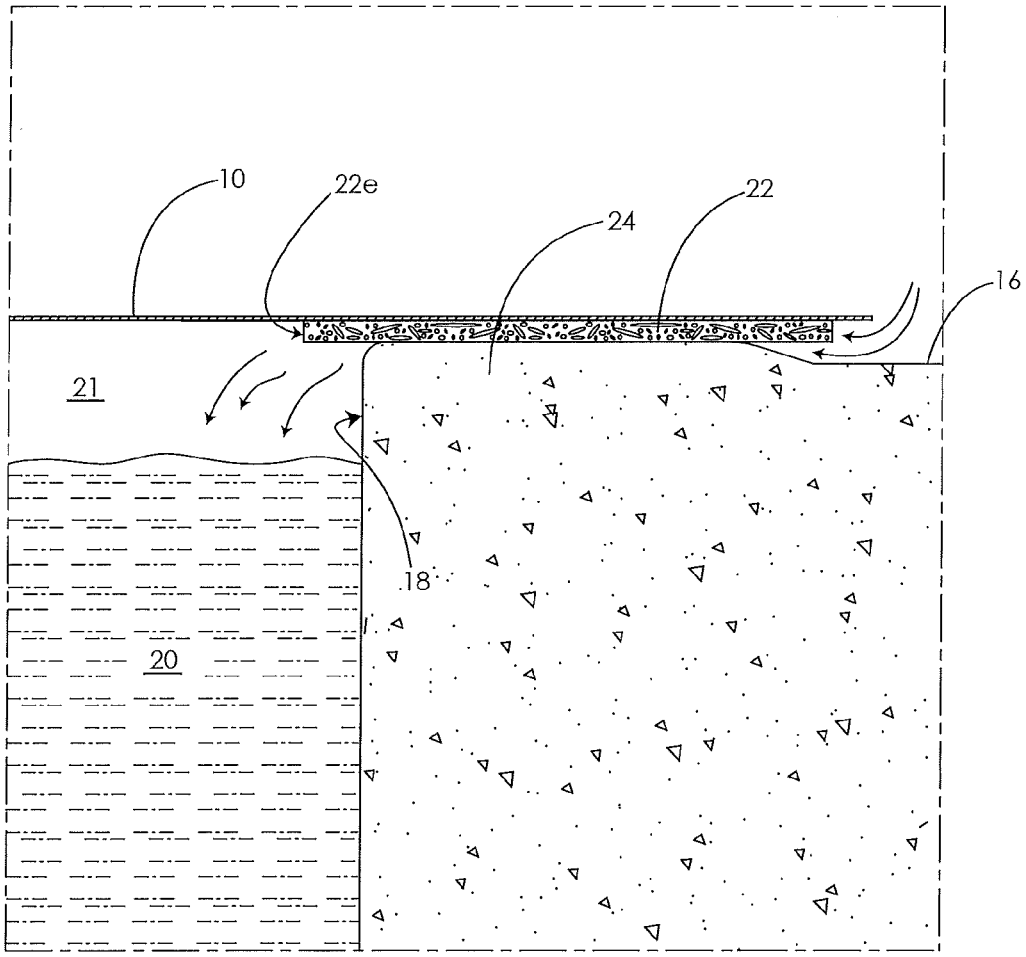
FIG. 4 is a cross-sectional view similar to FIG. 3 and showing the cover resting on the pad and showing air or water flow from the exterior and into the space above the water in the pool.

In accordance with an aspect of the present invention and as illustrated in FIG. 3, pad 22 may be comprised of an open-weave or open-mesh type material. Pad 22 thus includes fibrous material threads 24 and a plurality of air spaces 28. Air spaces 28 allow for air or water to flow through pad 22 from the area surrounding pad 22 and into the region 21 between cover 10 and water 20. The flow is directed particularly between the exterior and interior peripheral edges 22*d*, 22*c* of pad 22. It will be understood that air is also able to flow freely between region 21 and the area surrounding cover in the opposite direction to that indicated by the arrows in FIG. 4. Water may also flow in this opposite direction if the pool water rises above the level of the upper surface of coping 24. Because of the possibility for air and water to flow through pad 22, pad 22 tends to stay in position during wind, rain or snow storms. Additionally, the airflow through pad 22 allows for exchange of the air trapped in the region 21 between the water 20 in pool 18 and cover 10. There is thus a reduced tendency for bacterial growth on the underside of cover 10 and on the portions of the walls of pool 18 extending above the surface of water 20. Consequently, bacterial growth under cover 10 and foul smells from bacterial growth thereunder are kept to a minimum, if not totally eliminated.

The open weave material of pad 22 also enables an installer to thread straps through the material in instances where it is desired to secure pad 22 to rock waterfalls or other landscape features surrounding pool 18.

Suitable materials for pad 22 may includes various types of plastics and even recycled safety covers which are recycled and formed into a mat having a thickness "T". A suitable thickness "T" could be anything from about one sixteenth of an inch in thickness to about 2 inches. The plastic used in pad 22 may be infused with ultraviolet (UV) stabilizers and antimicrobial substances. The UV stabilizers will aid in resisting sun damage to the mat. The antimicrobials will resist bacterial and fungal growth within pad 22. Any other substances which will help pad 22 to stand up to harsh environments such as snow, ice, rain, and intense heat may be incorporated into the material of pad 22. It will be understood that materials other than plastics may be used in the fabrication of pad 22. Pad 22 may be cleaned by simply hosing it off. Pad 22 may be rolled up for storage purposes.

Pad 22 acts as cushioning between the peripheral regions of cover 10 and the concrete or stone coping 24 surrounding the edge of pool 18. Pad 22 thus aids in preventing the peripheral edges of cover 10 from rubbing against coping 24 and becoming damaged over time. Pad 22 thus aids in extending the life of cover 10. The open weave type material used in pad 22 enables pad 22 to grip onto coping 24. There is consequently no need to connect cover 10 to pad 22, thus saving time during installation of pad 22 and cover 10.

Figure 5:
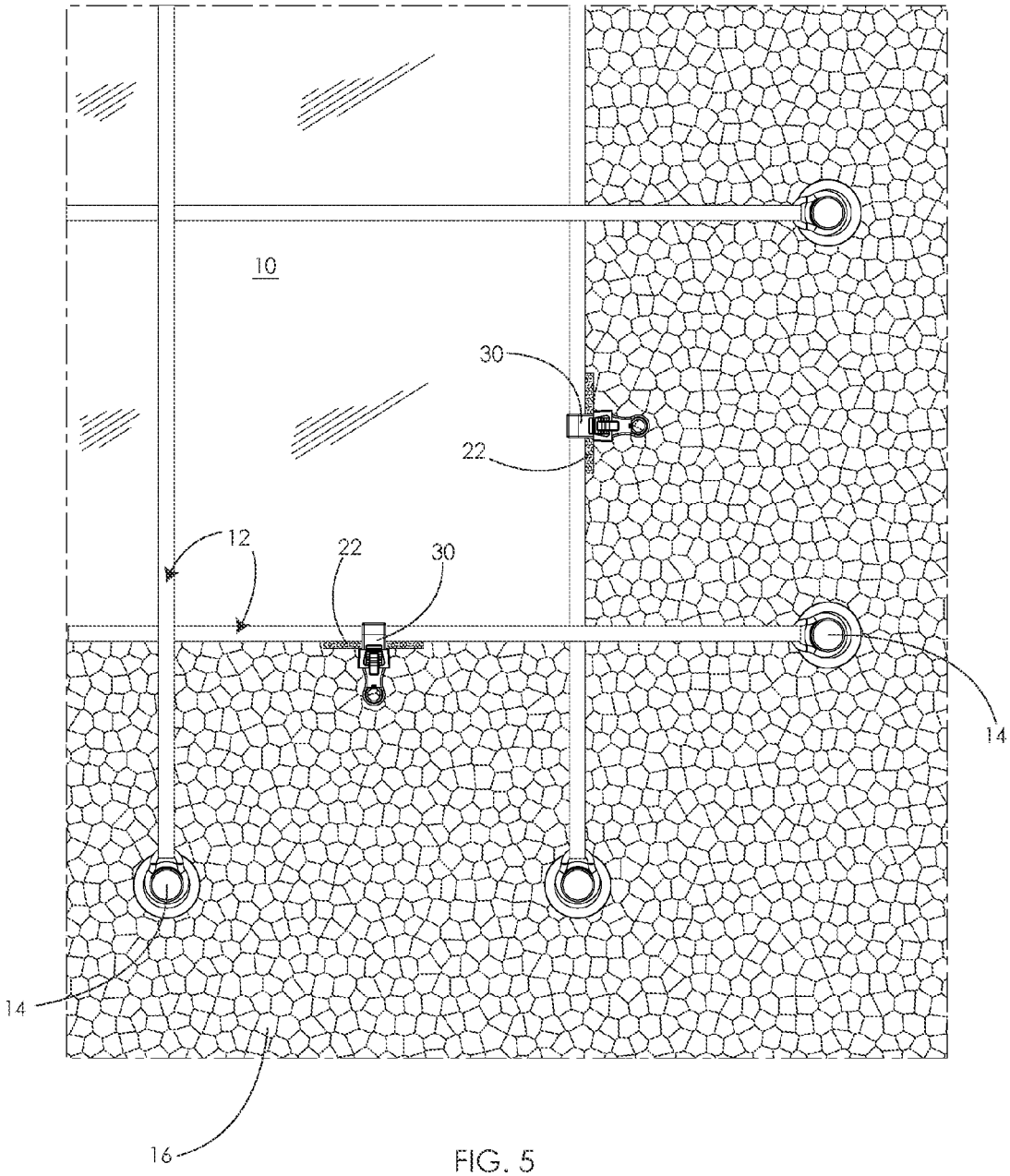
FIG. 5 is an enlarged top view of the bottom right hand corner of the cover and pad and showing a clips which are used to secure the cover and pad together.
Figure 6:
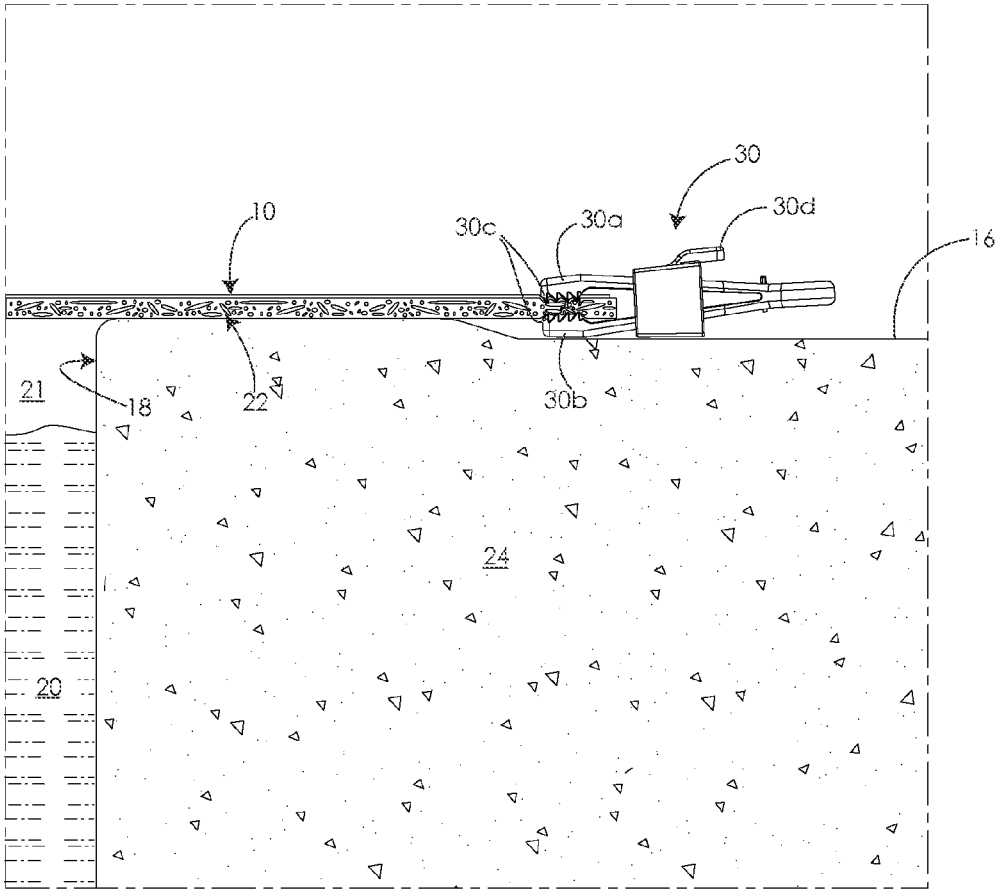
FIG. 6 is a cross-sectional view of the pad and cover similar to FIG. 4 but showing the clips securing the cover and pad together.

Of course, if desired, pad 22 may be engaged with cover 10 in any desired manner. In a first manner, cover 10 and pad 22 are secured together by way of clips, as illustrated in FIGS. 5 and 6. Engaging cover 10 and pad 22 together helps prevent leaves and other debris from blowing under cover 10. Even if cover 10 lifts slightly, the fibrous material of pad 22 clings to coping 24 and aids in preventing the debris from blowing under cover 10. With less debris making it through to water 20 of pool 18, when cover 10 is removed in the spring there is less clean-up of the pool required. Using clips 30 additionally aids in ensuring that pad 22 also will not accidentally slide into pool 18 or slide outwardly from under cover 10. Clips 30 as illustrated herein are clamping members which include opposing spring-loaded jaws 30*a*, 30*b* having gripping surfaces 30*c* thereon. Jaw 30*a* contacts the upper surface of cover 10 and jaw 30*b* contacts lower surface 22*b* of pad 22 when engaged. First and second jaws 30*a*, 30*b* are moved toward each other to clamp cover 10 and pad 22 adjacent each other. A release handle 30*d* is provided and is actuated to cause jaws 30*a* and 30*b* to separate from each other and release cover 10 and pad 22. It will be understood that a plurality of clips 30 is provided around the peripheral edge of cover 10 in order to secure cover 10 to pad 22.

Figure 7:
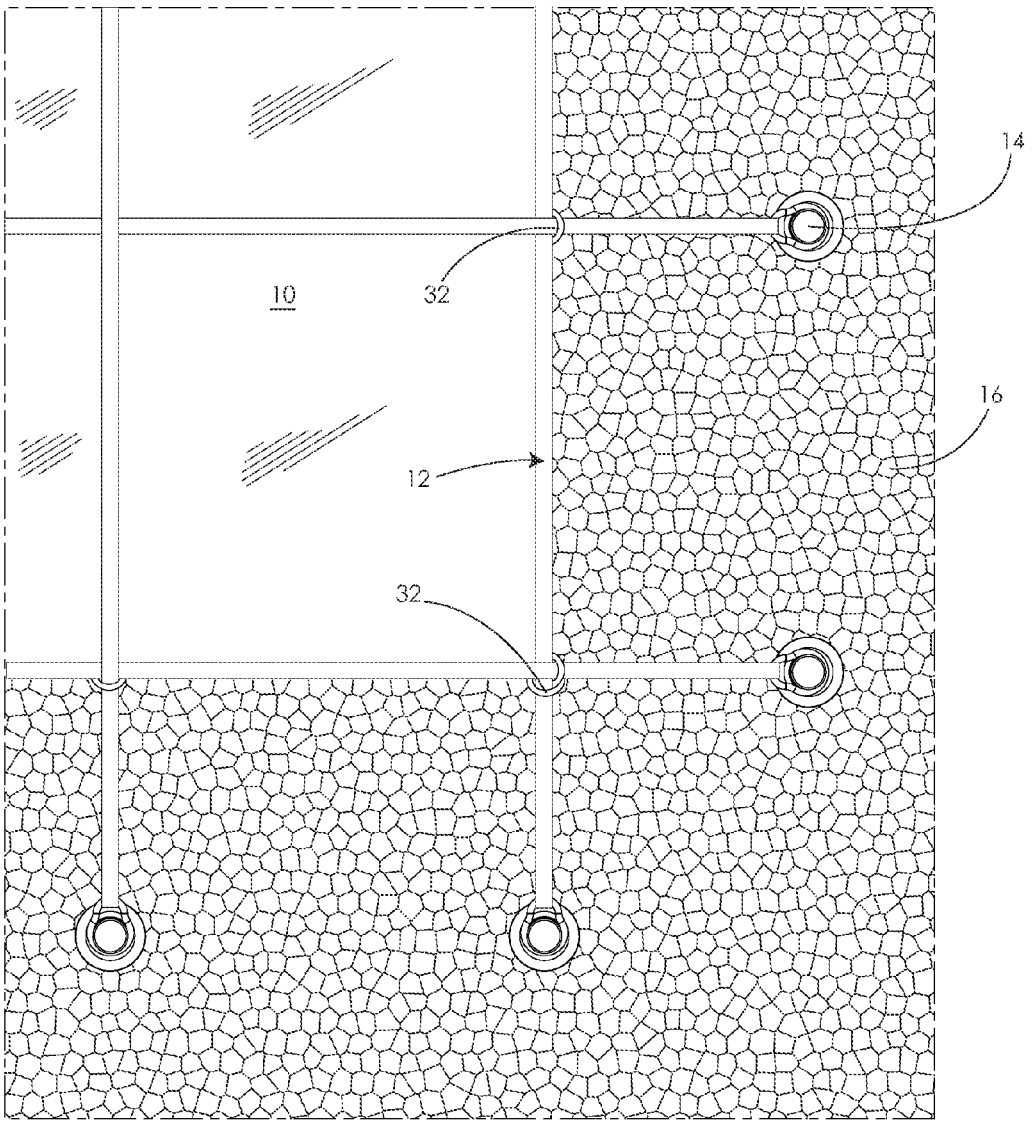
FIG. 7 is an enlarged top view of the bottom right hand corner of the cover showing cords which extend from the pad engaged with the strap assembly.
Figure 8:
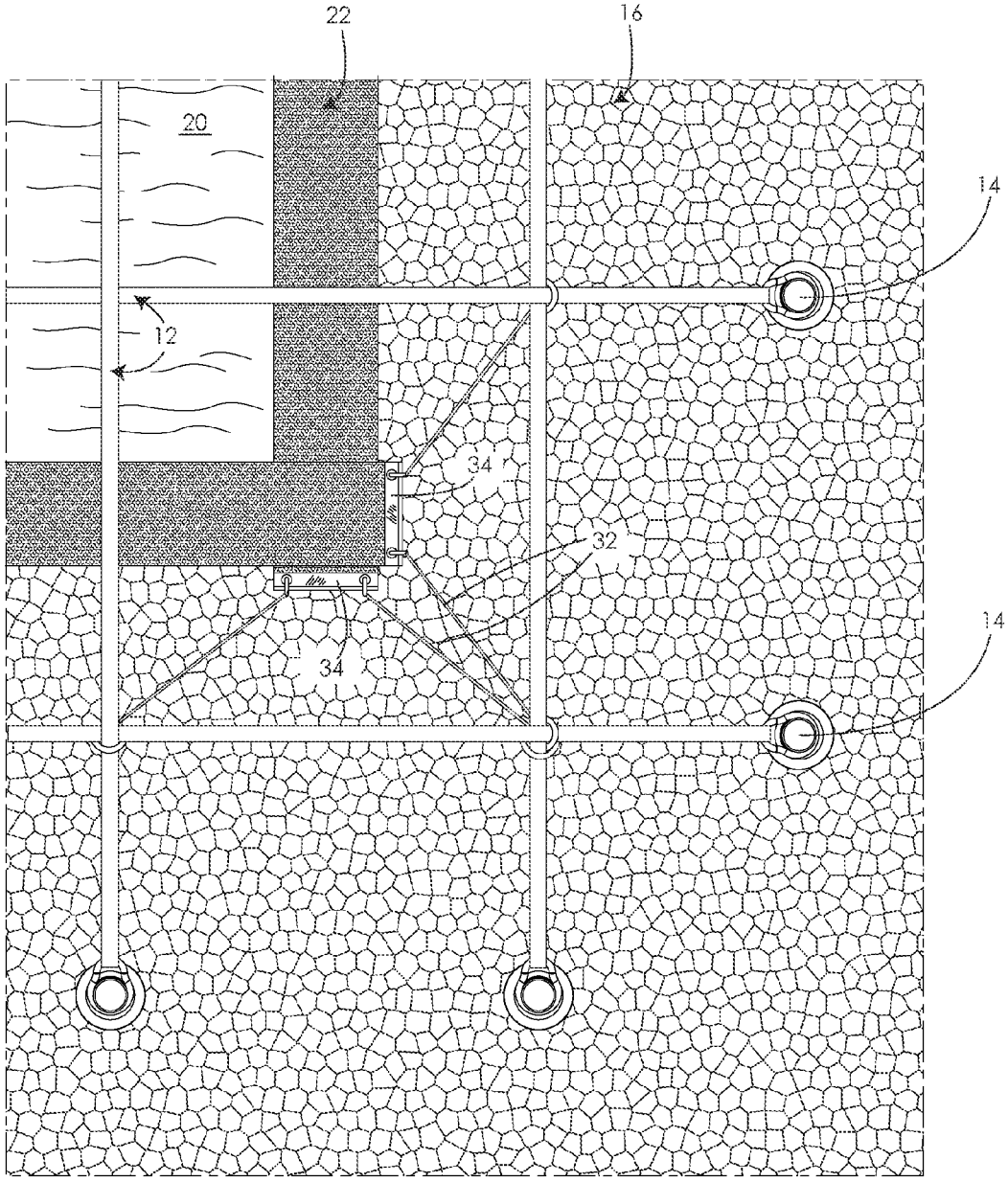
FIG. 8 is an enlarged top view similar to FIG. 7 but with the cover removed and showing the pad on the pool deck and with mounting brackets engaged with the peripheral edge of the pad and cords extending to secure the mounting brackets to the strap assembly.
Figure 9:
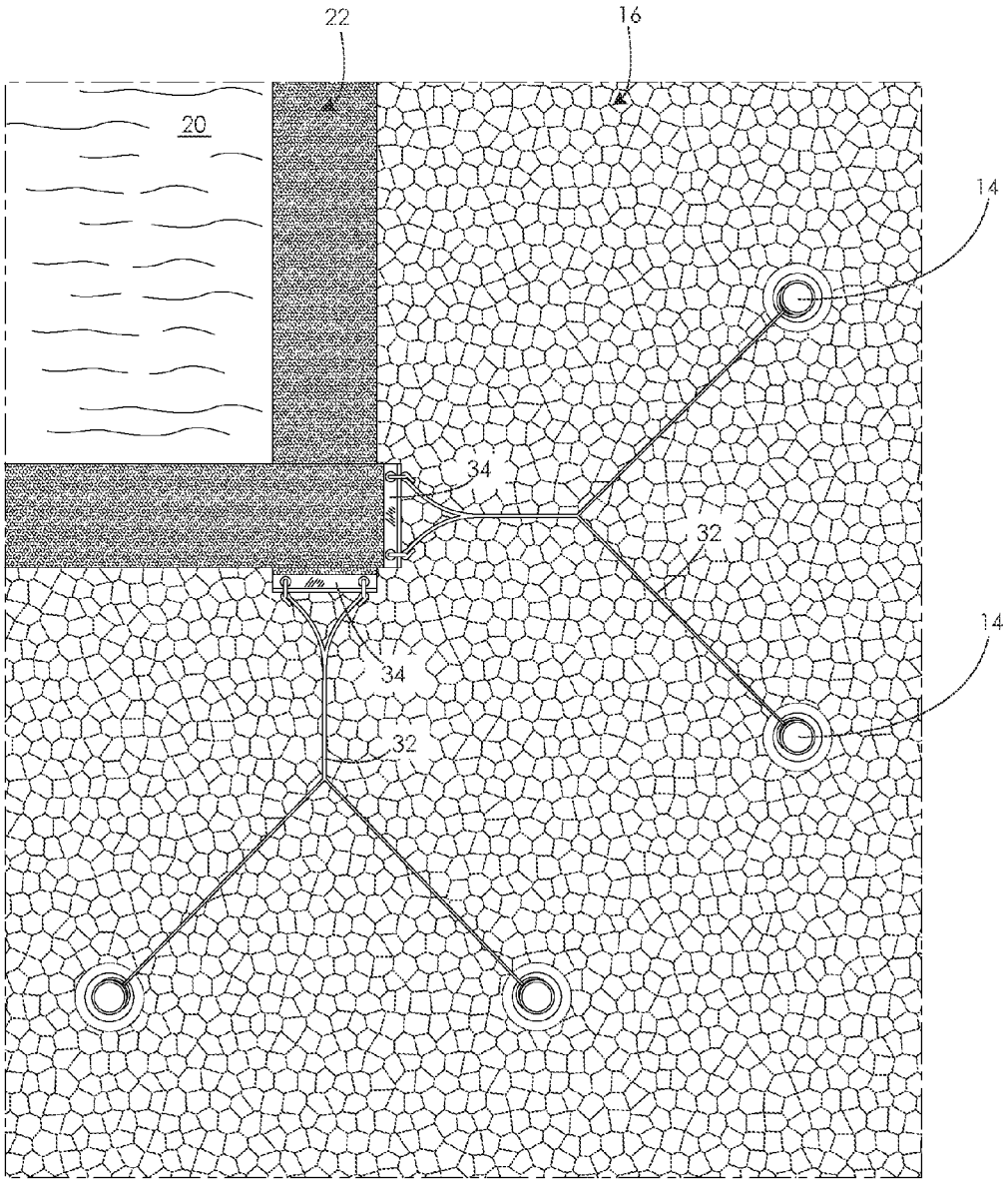
FIG. 9 is an enlarged top view similar to FIG. 8 but showing a different method of attaching the cords to the strap assembly.

Pad 22 may be engaged with cover 10 in other ways. FIGS. 7 and 8 show a situation where pad 22 is directly secured to strap assembly 12 and is thereby indirectly engaged with cover 10. These figures show cords 32 which are threaded through mounting brackets 34 (FIG. 7) engaged with exterior peripheral edge 22*c* of pad 22. Cords 32 may be rubber straps. Cords 32 are then threaded around regions of strap assembly 12. FIG. 9 shows an alternative way of engaging cords 32 with strap assembly 12. In some instances, mounting brackets 30 may be omitted and cords 32 may be directly secured to pad 22 by threading cords 32 through reinforced holes defined in pad 22; where the reinforced holes extend between upper surface 22*a* and lower surface 22*b*. Alternatively, cords 32 may be threaded through some of the air spaces 28 defined in pad 22.

It will be understood that instead of pad 22 being fabricated from a loosely woven or fibrous material which has air spaces formed therein, pad 22 may be specifically fabricated out of a generally solid material with a plurality of air-flow channels therein.

While cover 10 has been disclosed herein as being secured in place over pool 18 by way of strap assembly 12, it will be understood that cover 10 may be held in place in other ways. For example, cover 10 may be kept adjacent pool deck 16 by way of water bags. Pad 22 in accordance with an aspect of the present invention may be utilized with any type of safety cover no matter the method of securing that cover in place over pool 18.

Pad 22 may be used by positioning pad 22 on coping 24 surrounding an edge of pool 18; extending cover 10 over an opening to pool 18 and over the upper surface 22*a* of pad 22 and then securing cover 10 in place. The method may further include the step of engaging cover 10 and pad 22 together. In order to accomplish this step a clip 30 with a first jaw 30*a* and a second jaw 30*b* is utilized. First jaw 30*a* is positioned adjacent an upper surface of cover 10 and lower jaw 30*b* is positioned adjacent lower surface 22*b* of pad 22 and then first and second jaws 30*a*, 30*b* are moved toward each other to clamp and thereby secure the peripheral edges of cover 10 and pad 22 together.

Alternatively, instead of using clips 30, one or more mounting brackets 34 may be engaged on exterior peripheral edge 22*c* of pad 22. One or more cords 32 are secured to each mounting bracket 34 and then those cords 32 are secured to strap assembly 12 sewn onto cover 10 or are secured to at least one post 14 mounted in the ground or the deck surface 16 surrounding pool 18. Disengaging cover 10 and pad 22 is undertaken by reversing the aforementioned steps.

It will be understood that any other type of mechanism may be used to secure cover 10 and pad 22 together.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. In combination:

a cover for a pool, where the cover has an upper surface, a lower surface, and a peripheral edge extending between the upper and lower surfaces;

a pad positionable between the cover and a coping adjacent an edge of the pool; said pad having an upper surface, a lower surface, an interior peripheral edge and an exterior peripheral edge; wherein said paid has a width extending between the interior and exterior peripheral edges; and a thickness extending between the upper and lower surfaces; and a plurality of air spaces defined in the pad and which enable air or water to flow through the pad between an environment outside the cover and a region between an upper surface of water in the pool and the lower surface of the cover; and wherein the pad includes a plurality of fibers which extend outwardly from a lower surface thereof; and the lower surface of the pad is positionable on a coping surrounding a pool; and wherein the plurality of fibers are adapted to grip the coping such that the pad remains substantially in place on the coping during wind or rain without the need for tie-downs or other forms of securement.

2. The combination as defined in claim 1, wherein the cover has a width extending between a first region of the peripheral edge of the cover and an opposed second region of the peripheral edge thereof; and wherein the width of the pad is smaller than the width of the safety cover.

3. The combination as defined in claim 1, wherein the pad is comprised of a woven fibrous material which includes a plurality of threads interspersed with the air spaces.

4. The combination as defined in claim 3, wherein the threads are loosely woven together.

5. The combination as defined in claim 3, wherein the material is waterproof.

6. The combination as defined in claim 3, wherein the material includes one or both of ultraviolet stabilizers and antimicrobial substances.

7. In combination:

a cover for a pool, where the cover has an upper surface, a lower surface, and a peripheral edge extending between the upper and lower surfaces;

a pad positionable between the cover and a coping adjacent an edge of the pool; said pad having an upper surface, a lower surface, an interior peripheral edge and an exterior peripheral edge; wherein said paid has a width extending between the interior and exterior peripheral edges; and a thickness extending between the upper and lower surfaces; and a plurality of air spaces defined in the pad and which enable air or water to flow through the pad between an environment outside the cover and a region between an upper surface of water in the pool and the lower surface of the cover; wherein the pad is complementary to the peripheral edge of the cover, and an aperture is bounded and defined by the interior peripheral edge of the pad; and the aperture is adapted to be generally aligned with an opening defined by the coping surrounding the pool, whereby the pad circumscribes the pool opening.

8. The combination as defined in claim 7, further comprising an attachment assembly for engaging the pad and the cover together.

9. The combination as defined in claim 8, wherein the attachment assembly includes at least one clip mechanism which secures the peripheral edge of the cover to the exterior peripheral edge of the pad.

10. The combination as defined in claim 7, wherein the pad is comprised of a woven fibrous material which includes a plurality of threads interspersed with the air spaces.

11. The combination as defined in claim 10, wherein the threads are loosely woven together.

12. The combination as defined in claim 10, wherein the material is waterproof.

13. The combination as defined in claim 10, wherein the material includes one or both of ultraviolet stabilizers and antimicrobial substances.

14. The combination as defined in claim 7, wherein the thickness of the pad is from about one sixteenth of inch up to about two inches.

15. In combination:

a cover for a pool, where the cover has an upper surface, a lower surface, and a peripheral edge extending between the upper and lower surfaces;

a pad positionable between the cover and a coping adjacent an edge of the pool; said pad having an upper surface, a lower surface, an interior peripheral edge and an exterior peripheral edge; wherein said paid has a width extending between the interior and exterior peripheral edges; and a thickness extending between the upper and lower surfaces;

a plurality of air spaces defined in the pad and which enable air or water to flow through the pad between an environment outside the cover and a region between an upper surface of water in the pool and the lower surface of the cover;

an attachment assembly for engaging the pad and the cover together; and wherein the cover includes a strap assembly adapted to engage with pop-up posts provided in region surrounding the pool; and the attachment assembly includes:

one or more mounting brackets engaged with the exterior peripheral edge of the pad; and a plurality of cords engageable with the mounting brackets and with the strap assembly.

16. The combination as defined in claim 15, wherein the thickness of the pad is from about one sixteenth of an inch to about two inches; and the width of the pad is from about eight inches to about two feet.

17. The method as defined in claim 16, further comprising the step of engaging the cover and pad together.

18. A method of securing a cover over an opening to a pool;

providing a pad having an upper surface, a lower surface, an interior peripheral edge and an exterior peripheral edge; wherein said paid has a width extending between the interior and exterior peripheral edges; and a thickness extending between the upper and lower surfaces; and wherein the pad is adapted to be positioned between a coping adjacent an edge of a pool and a bottom surface of the cover; and a plurality of air spaces defined in the pad and which enable air or water to flow through the pad;

positioning the pad on a coping surrounding an edge of the pool; wherein the pad is adapted to grip the coping and remain in place on the coping during wind or rainstorms without additional securement;

extending the cover over an opening to the pool and over the upper surface of the pad; and securing the cover in place.

19. The method as defined in claim 18, wherein the step of engaging the cover and pad together includes:

opening a clip;

positioning the clip with a first jaw adjacent an upper surface of the cover and a lower jaw adjacent the lower surface of the pad;

moving the first and second jaws of the clip toward each other;

securing the cover and pad together by way of the first and second jaws.

20. The method as defined in claim 19, further comprising:

engaging one or more mounting brackets on the exterior peripheral edge on the pad;

securing one or more cords to each mounting bracket;

securing the one or more cords to a strap assembly provided on the cover or to at least one post mounted in a ground or deck surface surrounding the pool.

* * * * *